US005343646A

United States Patent [19]

Cobb et al.

[11] Patent Number: 5,343,646

[45] Date of Patent: Sep. 6, 1994

[54] SIGN APPARATUS WITH IMPROVED MOUNTING OF MESSAGE PANELS

[75] Inventors: Ronald W. Cobb, Atlanta; Benjamin H. Bell, Avondale Estates, both of Ga.

[73] Assignee: Apco Graphics, Inc., Atlanta, Ga.

[21] Appl. No.: 966,134

[22] Filed: Oct. 23, 1992

[51] Int. Cl.[5] ..... G09F 7/00

[52] U.S. Cl. ..... 40/585; 40/618; 40/622

[58] Field of Search ..... 40/585, 605, 64, 618, 40/620, 622, 657; 24/453, 297, 625

[56] References Cited

U.S. PATENT DOCUMENTS

| | | | |
|---|---|---|---|
| 2,912,777 | 11/1959 | Radcliffe | 40/618 |
| 2,966,754 | 1/1961 | Orkin | 40/618 |
| 3,339,301 | 9/1967 | Doris et al. | 40/620 |

FOREIGN PATENT DOCUMENTS

| | | | |
|---|---|---|---|
| 119003 | 9/1970 | Norway | 40/620 |
| 8100162 | 1/1981 | PCT Int'l Appl. | 40/618 |

*Primary Examiner*—Kenneth J. Dorner
*Assistant Examiner*—Cassandra Davis
*Attorney, Agent, or Firm*—Jones & Askew

[57] ABSTRACT

Sign apparatus for directory or other applications and having removable sign inserts positionable at any location along a dimension of the sign. The sign inserts are held in place by a number of elongated rails located behind the inserts. Each rail contains an elongate track with a slotted opening facing the back side of the sign inserts. The tracks receive an end of an elastically-deformable fastener attached to the back of the sign insert. Each fastener expands within the track to prevent unimpeded removal of the insert, while permitting the insert to slide within the track for longitudinal positioning of the insert along the rails.

20 Claims, 5 Drawing Sheets

SIGN APPARATUS WITH IMPROVED MOUNTING OF MESSAGE PANELS

FIELD OF THE INVENTION

This invention relates in general to message display apparatus, and relates more particularly to signs intended for use as directories and the like, including directories where the message or other information displayed by the sign is expected to change from time to time.

BACKGROUND OF THE INVENTION

Signs intended for use as directories typically display the names of various persons or other entities together with their office numbers or locations. For example, the typical directory sign located in the lobby of a building will name the firms or organizations located in that building, and possibly the names of at least some individuals therein, together with information such as room numbers or building floors where particular persons or organizations are located. The contents of these signs are updated from time to time as people come and go within the locations covered by the sign.

Signs intended for use as directories and the like usually are designed so that individual names or addresses can be changed without the need to fabricate a new display panel containing all information on the sign. In this way, the cost and ease of replacing only one or a few names is much less than if that same number of changes required replacing the entire information display of the sign. For example, replacing it is known in the art to provide directory signs in which each name or other directory location appears on an individual message panel which forms part of the overall sign. The directory sign, thus, is composed of a number of those message panels displayed in a desired alphabetical or other arrangement, and mounted within a frame or other structure defining the overall sign. Such signs may include receptacles or other positioning structure to locate each individual message display panel in a fixed location or a predetermined array of locations on the sign, so that the resulting array of numerous message panels provides an attractive uniform appearance resembling a single overall monolithic display, rather than a composite of numerous individual message panels.

Those skilled in the art will recognize different techniques for attaching the individual message display panels within directory signs of the prior art. Generally speaking, each such display panel should be individually removable and attachable without disturbing adjacent panels making up the sign. Moreover, removing a particular message display panel and replacing it with a new one should take minimum time and require no unique tools, so that the cost of maintaining and installing a directory sign can be minimized. In an effort to meet these and other functional requirements, various techniques are known for attaching individual message panels to directory signs and the like. For example, each message panel can be provided with an adhesive backing layer such as double-sided adhesive tape for adhering the individual panels to a vertical substrate forming part of the overall sign assembly. The use of such adhesive fastening techniques alone, however, requires selecting an adhesive that remains effective over the expected lifetime of the sign, without diminishing due to aging or extremes of temperature or humidity. Although such adhesives are known, their desirable characteristics mean that intentional removal of a particular message panel often is accomplished only with considerable difficulty, sometimes including damage to the sign itself. This creates a problem where removing only one message panel of a directory sign also requires relocating a number of other message panels of the sign, because each relocated message panel must first be removed from its original location on the sign.

Another technique for removably affixing individual message panels to a directory sign requires individual mounting studs affixed to the back side of each message panel. These mounting studs are pressed into corresponding holes drilled or otherwise formed for the purpose in one or more members located behind the plane of the message panels. This mounting technique requires precise lateral and vertical alignment of the studs on the individual message panels, and also of the holes for receiving those studs, so that the resulting directory sign maintains a uniform appearance of all message panels making up the sign. As a result, directory signs using this prior-art technique are relatively expensive to assemble and maintain. Moreover, the backing holes usually are formed at periodic intervals along the backing member, making it difficult to include message panels or divider strips having an irregular width or shape.

SUMMARY OF INVENTION

Stated in general terms, the present invention comprises apparatus for supporting panels on a wall or another surface. The apparatus includes at least one support member having an elongated track with a slot to permit access from a front side of the support member. Attached to a back side of the panel is a fastener configured for insertion through the slot into the track to retain the panel to the support member, and thereafter slideable along the track to permit adjusting the position of the panel relative to the support member and the remainder of the sign. The position of individual panels thus is freely adjustable without requiring individual holes for mounting each panel at a predetermined position on the sign.

Two or more support members preferably are provided according to the present invention, each support member having a track and slot as aforementioned and receiving another such fastener attached to the back of the panel. Once the fasteners are inserted through the slots into the respective tracks, the panel is easily moveable to any position along the longitudinal extent of the tracks. In the case of the present invention adapted for a directory sign, suitable framework surrounds the support members to define the peripheral structure of the sign.

Stated somewhat more particularly, the tracks have an elongate channel open to a slot and the fasteners for insertion into the slotted channels preferably are elastically deformable to pass through the slot and enter the channel. The fasteners thereafter expand within the channel to exceed the width of the slot. The expanded fastener is slideable within the channel so that a panel attached to the fasteners can be positioned along the support member. The fasteners are withdrawable from the channels only in response to force greater than the amount of force required to insert the fasteners into the channel, thereby impeding removal of the panel from the support members.

In one preferred application of the present invention, each panel so mounted on the support members can be one of several message support panels making up a composite sign, such as a directory sign or the like. It should be understood that some of these sign panels contain indicia identifying particular persons, offices, or other locations, and other panels may remain blank or be used as spacers or dividers visually setting apart different portions of the directory sign. Further yet, the sign panels making up a particular directory sign can have different dimensions and need not be of the same width. Preferably, the width of each sign panel is some multiple of a basic modular width permitting an arrangement of different-width sign panels arrayed along the length of the support members, because the continuous slotted channel and the fastening members slidably engageable therein do not confine the sign panels to any particular predetermined location along the length of the support members.

Stated in greater detail, the fasteners used with the present invention comprise a terminal portion elastically deformable to pass through the slot and enter the channel, and expandable within the channel to a configuration exceeding the width of the slot. The expanded terminal portion of each such fastener impedes withdrawal of the terminal portion from the channel. The fastener also has a proximal portion operative for attachment to the panel. The expanded terminal portion of fastener is slideable within the channel, so that the panel can be positioned wherever desired along the length of the channel. The terminal portion and proximal portion of the fastener are at opposite ends of an intermediate portion which extends through the access slot of the channel and is slideable within that slot.

Considering the support members in further detail, the slot of the support member has a front surface for confronting the back surface of the sign insert retained against the support member. A recessed region of predetermined depth flanks the slot and is inset from the front surface of the support member, so that the elastically deformable portion of the fastener extends through the recessed region before entering the slot. This recessed region thus reduces the thickness of the slot through which the deformable member must pass to enter the channel, thereby reducing the amount of manual force that must be applied against the front side of the sign insert to force the fastener through the slot and into the channel.

Accordingly, it is an object of the present invention to provide improved apparatus for supporting a panel on a surface.

It is another object of the present invention to provide an improved sign apparatus.

It is a further object of the present invention to provide an improved directory sign having individual sign panels.

It is still another object of the present invention to provide a sign having sign panels selectively locatable at variable locations along a predetermined dimension of the sign.

Other objects and advantages of the present invention will become more readily apparent from the following disclosure of a preferred embodiment.

DETAILED DESCRIPTION OF PREFERRED EMBODIMENTS

Figure 1:
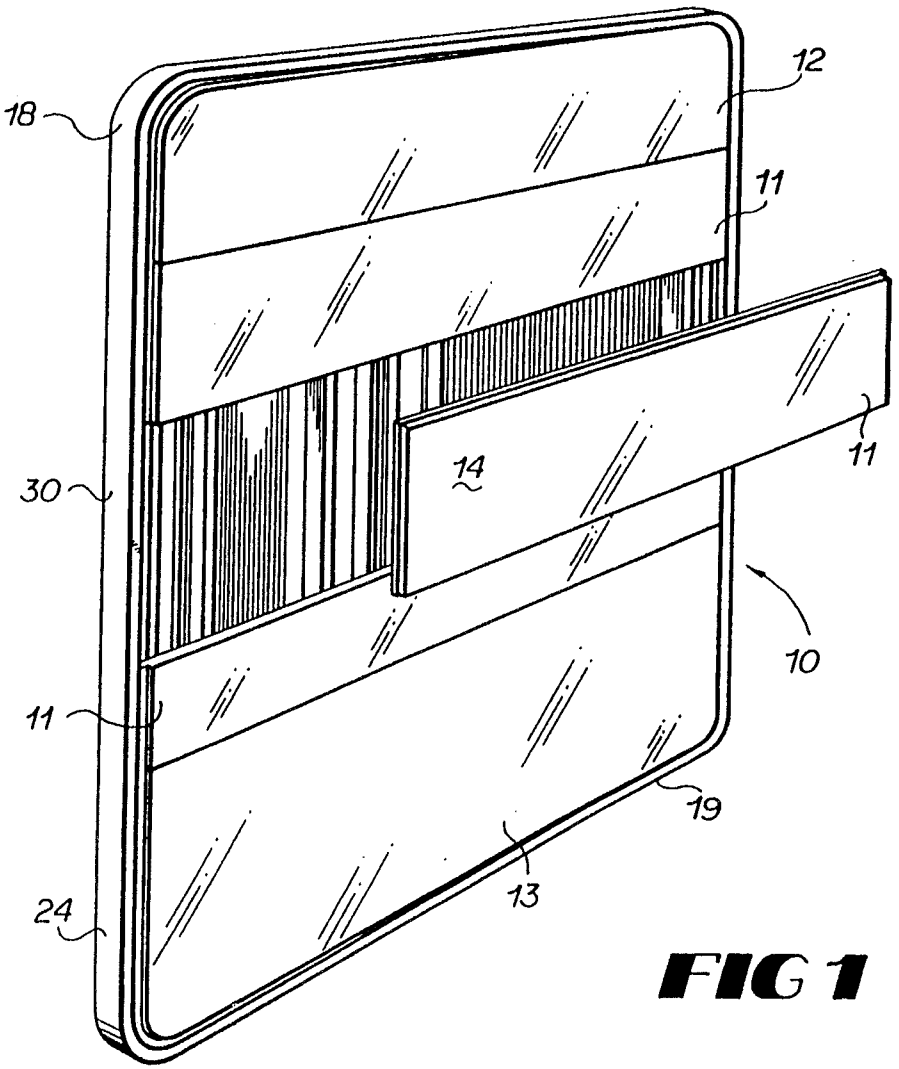
FIG. 1 is a pictorial view showing a directory sign according to a first preferred embodiment of the present invention, with one panel insert removed for illustration.
Figure 2:
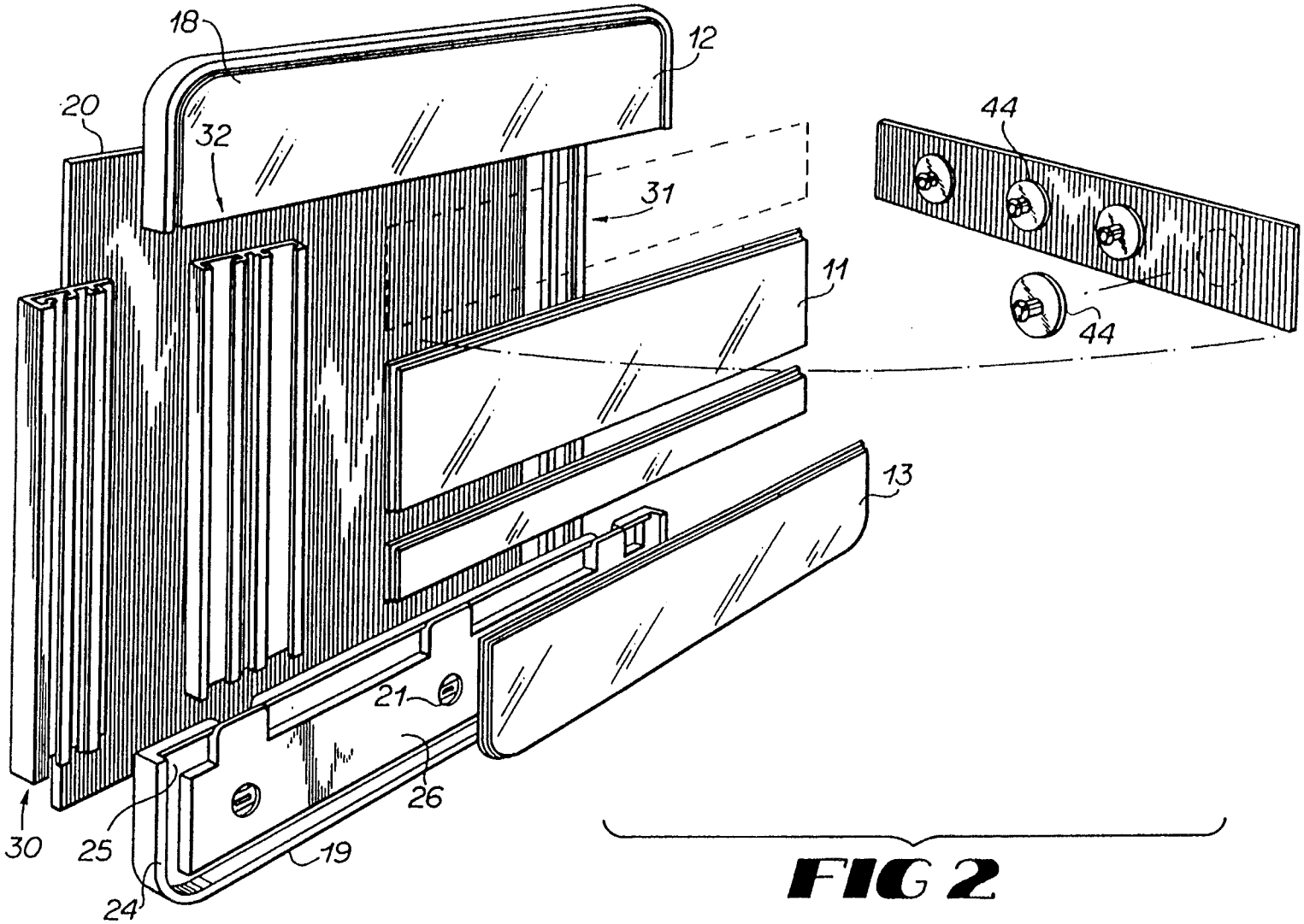
FIG. 2 is a fully-exploded pictorial view of the sign shown in FIG. 1.

Turning first to FIGS. 1 and 2, there is shown generally at 10 a directory sign according to the first preferred embodiment of the present invention. This sign 10 includes a number of separate insert panels 11 located between a header insert 12 at the upper end of the sign and a base insert 13 at the lower end. The header insert 12 and base insert 13 also may be removably attached to the sign, as will become apparent from the following description. The several insert panels 11 as well as the header and base inserts for the preferred embodiment are molded of suitable plastic material, although neither the material nor method of fabricating those inserts is considered critical. Those skilled in the art will recognize that the outer surface 14 of each insert panel 11 is intended to bear indicia of the kind normally associated with directories and directory signs. These indicia can include names of persons, departments, or organizations and the office numbers or locations associated with those names, although of course the indicia are not so limited. These indicia are applied to the outer surface of the insert panels by screen printing, by affixing pressure-sensitive vinyl or dimensional letters, or by any other suitable technique. It will also be understood that indicia can as well be applied to the outer surfaces of the header insert 12 and base insert 13 if desired.

The sign 10 includes a header holder 18 and a base holder 19, each of which is secured to a back plate 20 by means of double-sided adhesive tape (not shown). The holders 19 and 20 each have rounded corners defined by a rim 24 projecting outwardly from the base 25 of the holder. A raised region 26 forms part of each holder and extends forwardly from the base 25, and the header insert 12 and base insert 13 are attached to the respective raised regions by an attaching technique described below and utilizing the holes 21 formed in the front surface of the raised region 26. Although the header and base inserts are not permanently attached to the respective header and base holders, these inserts nevertheless seldom are changed in a typical directory sign of the present embodiment. Furthermore, the positions of the header insert 12 and base insert 13 are defined relative to the overall sign 10. As discussed more fully below, alterative embodiments having a rectangular overall design provide greater flexibility of overall layout than do the embodiments typified in FIGS. 1–4.

Figure 4:
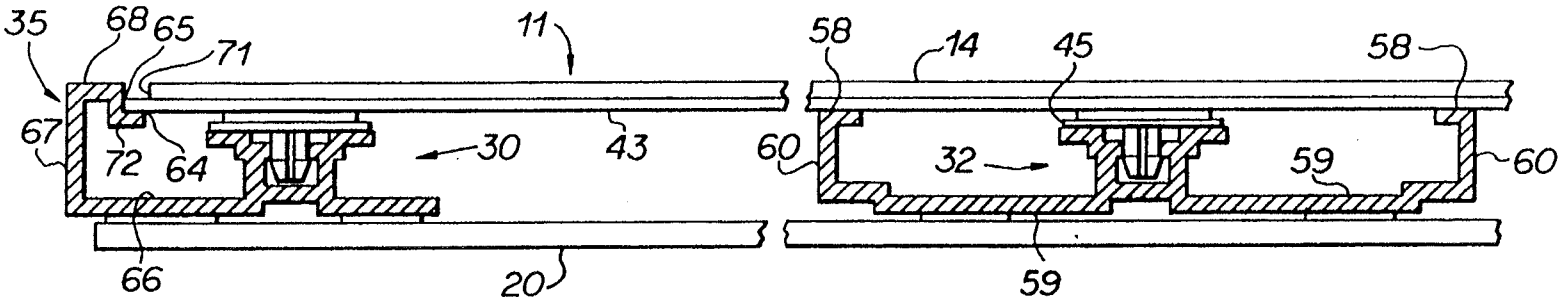
FIG. 4 is a horizontal section view of the sign of FIG. 1 in assembly.

A number of support rails are affixed to the back plate 20 of the sign 10 and extend between the header holder 18 and base holder 19. These support members include the vertical side rails 30 and 31 on opposite sides of the sign 10, and at least one other rail 32 intermediate of and parallel to the side rails. Only a single intermediate rail 32 is shown in the embodiment shown in FIGS. 1 and 2, but it should be understood that two or more such intermediate rails may be appropriate depending on the width of the sign 10 and, correspondingly, on the length of the panel inserts 11 forming part of that sign. The side rails and intermediate rail(s) support the panel inserts and extend perpendicular to the length of those inserts, as best seen in FIGS. 2 and 4.

Figure 3:
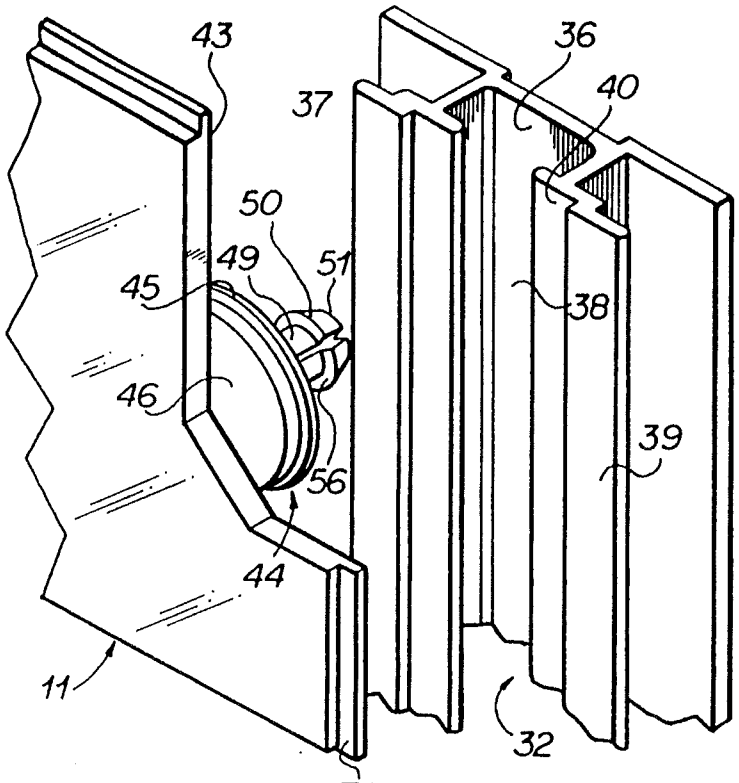
FIG. 3 is an enlarged exploded view showing details of the support rail and fastening member in the preferred embodiments.

Although the side rails 30 and 31 include an exterior trim portion 35 visible in the assembled sign 10 but missing from the intermediate rail 32, all the rails include an elongate channel 36 extending along the length of the rail. This channel, together with related structural details of the rails, is best seen in FIG. 3. The front wall 37 of each channel 36 is interrupted to define a slot 38 extending the length of the channel and allowing access to the channel. The width of the slot 38 thus is less than the width of the underlying channel. The front wall 37 of the channel 36 is recessed behind the flanking front surfaces 39 of the rail itself. The wall 37 containing the slot 38 thus flanks the slot and extends along the length of that slot to form the relief 40, for a purpose discussed below. As best seen in FIG. 3, each front surface 39 of the rails extends laterally outside the width of the channel 36.

The back surface 43 of each panel insert 11 carries a number of fasteners 44 that selectively and removably snap into the side rails 30, 31 and the intermediate rail 32. As best seen in FIGS. 3 and 4, each fastener 44 has a disk portion 45 at an end proximate to the back surface 43 of the panel insert 11. This disk portion 45 is attached to the back surface 43 by suitable means such as the double-sided adhesive foam tape 46 selected to provide a very high bond between the disk portion and the panel insert. As will become apparent, it is preferred that the adhesive bond between the fasteners 44 and the panel inserts be of greater strength than the fastening force exerted by the fasteners on the side rails and intermediate rail. The fasteners 44 may be considered as being semipermanently adhered to the back surface 43 of the panel insert, meaning that the fasteners remain affixed to the panel inserts as those inserts are removed from the sign 10 in normal usage. Each fastener 44 may be attached to its corresponding panel insert substantially along the longitudinal center line of that insert, although some displacement from that center line will not affect the operation of the sign. However, it is important that the longitudinal position of each fastener 44 along the length of each panel insert be equal to the spacing of the side rails 30, 31 and the intermediate rail(s) 32 present on the sign 10. This is best accomplished by pre-locating the fasteners 44 in the rails of the assembled sign prior to securing the disk portions 43 to the respective panel inserts.

Extending back from the disk portion 45 of each fastener 44 is an intermediate portion 49 in the form of a generally-cylindrical shank whose diameter is the same as or slightly less than the width of the slot 38 communicating with the channel 36 in each rail. A channel-engaging terminal portion 50 is formed at the end of the intermediate portion 49 distant from the disk portion 45. The terminal portion 50 has the shape of a truncated cone whose base 56 adjoins the intermediate portion 49 and has a diameter greater than that of the intermediate portion and greater than the width of the slot 38. The diameter of the outermost end 51 of the terminal portion 50 preferably is somewhat smaller than the width of the slot 38. The intermediate portion 49 and terminal portion 50 of each fastener 44 preferably are unitary and formed by two or more prongs extending cantilever-fashion outwardly from the back side of the disk portion 45. This construction makes the diameter of the terminal portion 50 elastically deformable in the radial direction.

The operation of the directory sign as thus far described is now considered. The basic directory sign 10 is assembled with the side rails 30 and 31 and one or more intermediate rails 32 extending between the header holder 18 and the base holder 19. These components are affixed to the back plate 20 as previously described. Each rail 30, 31, and 32 extends a distance between the header and base holders, and that distance may be either one of several predetermined lengths selected in conjunction with panel inserts 11 of modular widths, or may be of any other length as determined for a particular application. Assuming the rails are of a so-called standard length, the width of each panel insert 11 can be any of various predetermined submultiples of that length. For example, panel inserts 11 in an actual embodiment of the present directory sign are selected from one of three sizes, namely, a small width of $1\frac{1}{8}$ inches, a medium width of $2\frac{1}{4}$ inches (twice that of the small insert), and a large insert of $3\frac{3}{8}$ inches (three times the width of the small insert). In this embodiment, the length of each rail 30–32 is a desired whole number multiple of $1\frac{1}{8}$ inches, the width of the smallest standard panel insert 11. The particular number of that multiple for any application depends on the number of panel inserts, the desired width of each particular insert, and the desired mix of those inserts for a particular application. This diversity of widths of panel inserts 11 is illustrated in FIGS. 1 and 2, and is described below in greater detail with respect to FIG. 6.

Once a particular selection and arrangement of panel inserts 11 is chosen and the desired indicia applied to the outer surface 14 of each panel insert, fasteners 44 are adhesively affixed to the back surface 43 of each insert by pre-installing the fasteners into the slots of the rails and then applying the insert onto the double-sided adhesive tape present on the fasteners while the insert is properly aligned along its length. Each fastener 44 is pre-installed by placing it against the rail with the outermost end 51 of the fastener aligned with the slot 38 in the rail. By applying force to the disk portion 45 of the fastener 44, the terminal portion 50 of the fastener is elastically deformed to pass through the slot 38 and enter the channel 36 behind the slot. The terminal portion 50 of the fastener substantially returns to its normal configuration within the channel 36, as illustrated in FIG. 4, with the enlarged base 56 of the terminal portion contacting the back side of the channel front wall 37 to prevent easy withdrawal of the terminal portion from the channel.

The header insert 12 and base insert 13 are attached to the sign 10 in much the same way as the panel inserts. Referring to FIG. 2, each hole 21 in the raised region 26 of the base holder 19 (and corresponding holes in the header holder 18) is configured to receive and retain the terminal portion of a fastener 44. With those fasteners (not shown in FIG. 2) installed in the holes 21, the header insert 12 and base insert 13 are pressed against the adhesive tape on the disk portion of each fastener so as to secure the inserts to the fasteners. Because the header insert and base insert always occupy the same vertical position on the sign 10, the vertical adjustability afforded to the panel inserts 11 by the slotted rails 30 . . . 32 is not required and those rails need not extend to support the header and base inserts. However, it will be understood that the raised region 23 and front surface 39 of each slotted rail must have a common elevation so that the header insert, the base insert, and the panel inserts all occupy a common plane.

With each panel insert 11 thus attached to the side rails and intermediate rail of the sign 10, the intermediate portion 49 of each fastener 44 remains a sliding fit within the slot 38 of the corresponding channel. This sliding fit allows moving the panel insert in the lateral direction, that is, along the length of the parallel rails 30-32, to provide the desired positioning of that panel insert on the sign 10. Thus, once a particular panel insert 11 is attached to the rails, that panel insert can be moved up or down along the rails to provide a space for attaching other panel inserts as necessary to occupy the entire distance between the header holder 18 and base holder 19. It will now be understood that the lateral placement of each fastener 44 on the back surface 43 of the panel inserts is not significant, because any deviation of a fastener from a nominal midline position along the panel insert merely places that fastener at a slightly different location along the length of the continuous slot 38 in the corresponding rail engaged by that fastener.

Although the base 56 on the terminal portion 50 of each fastener 44 expands within the channel 36 to hold the fastener there in place, the elastic deformability of the fasteners is selected to allow withdrawing the fasteners from within the channels. Nonetheless, the force required to withdraw each fastener from a channel through the slot 38 preferably is greater than the force originally required to insert the fastener into the channel with the aid of the frustoconical outer surface of the terminal portion 50. Thus, once a panel insert 11 has been attached to the sign 10, that panel can be nonetheless be withdrawn by applying a greater pulling force in an outward direction perpendicular to the front surface 14 of the panel insert. This removal force is best applied by means of heavy-duty suction cups (not shown) that are temporarily attached to the front surface 11 for manually gripping and pulling the panel insert outwardly with sufficient force to elastically deform the terminal portion 50 of each fastener to the extent necessary for withdrawing the terminal portion through the slot 38 of the channel. As previously mentioned, the adhesive connection between the fasteners 44 and the back surface 43 of the panel inserts should be chosen to withstand the pulling force necessary for withdrawing the fasteners through the slot 38 of each channel.

With the basic operation of the preferred embodiment having been explained, some other features of the present invention as shown in that embodiment are now discussed. Referring to FIGS. 3 and 4, it will be seen that the front surface 39 of each side rail 30 and intermediate rail 32 contacts the disk portion 45 of the fastener 44 confronting that rail. This arrangement allows the panel insert 11 to stand off a short distance from the front surface 39, and the adhesive foam tape 46 is sufficiently compressible if needed to allow urging the terminal portion 50 of the fastener through the slot 38 in response to force applied against the front surface 14 of the panel insert.

The effect of the relief 40 provided by the front surface 37 of the channel 36 is best seen in FIG. 4. This relief 40 reduces the thickness of the slot 38 through which the terminal portion 50 of the fastener 44 must be pushed to enter the channel 36, thereby reducing the amount of force needed to engage the fasteners within the channels and eliminating wobble when inserting the fasteners.

The intermediate rails 32 can include the support surfaces 58, FIG. 4, in contact with the back surface 43 of the panel inserts 11 when attached to the rails. These support surfaces 58 preferably are a part of the extrusion forming the intermediate rail 32 and am carried by the webs 59 extending outwardly from the structure defining the channel 36. Each web 59 is substantially parallel to the front surface 39 of the rail 32. The outer ends of each web 59 join an uptumed portion 60 extending forwardly from the back plate 20 of the sign. The terminal end of each upturned portion 60 is at a right angle to that portion and extends inwardly a short distance toward the intermediate rail 32, thereby exposing an outer surface comprising the support surface 58. As best seen in FIG. 4, that support surface 58 occupies a plane spaced forwardly a short distance in front of the front surface 39 of the rail 32, so as to accommodate the thickness of the disk portion 45 for the fastener 44. These support surfaces 58 provide a firm and predetermined backstop for the panel inserts 11 and may be particularly useful to maintain a plane appearance of panel inserts in signs whose panel inserts have a relatively long span between the side rails 30 and 31 at either end of the inserts.

Each side rail 30 and 31 includes a support surface 64, coplanar with the support surfaces 58 of the intermediate rail 32, which underlies and provides support for an end 65 of the panel insert. The support surface 64 shown in FIG. 4 is an integral part of the side rail 30 and is formed at the terminal end of the exterior trim portion 35, which in turn is connected to the side rail by the web 66 extending outwardly from one side thereof. The trim portion 35 includes a side member 67 extending forwardly from the web 66 and forming part of the exterior side of the sign 10. The forward end of the side member 67 tums inwardly to define the front surface 68 preferably coplanar with the front surface 39 of the intermediate rail 32 so as to contact and support the back surface 43 of the panel inserts 11 forming part of the sign. Referring to FIG. 1, the front surface 68 of each side rail preferably is aligned with the rim 24 of the header holder 18 and base holder 19, so that the front surfaces and rims together form the appearance of a trim molding or the like extending around the entire periphery of the sign 10.

A marginal part of each panel insert 11 is set back from the front surface of the insert panel to form the reveal 71 at the periphery of the panel insert. Each end 65 of the panel inserts is supported by an L-shaped flange 72 extending rearwardly and laterally from the front surface 68 of the exterior trim portion 35, and the outer surface of that flange is substantially coplanar with the back surface 43 of the panel insert. The flange 72 thus provides back support for the panel inserts and also blocks from view the inner portions of the assembled sign 10. As best seen in FIG. 1, the reveals 71 at the ends 65 of each panel insert 11 are mutually aligned with similar reveals formed around the periphery of the header insert 12 and base insert 13 to provide the visible front surface of the sign 10.

Although the exterior trim portion 35 of the sign 10 forms right angles as seen in section view, FIG. 4, it should be understood that alternative configurations are possible with the present invention. For example, the outer surface of the exterior trim portion can be beveled at an angle of 45 degrees relative to the front and sides of the sign. As a further alternative, the outer surface of the exterior trim portion can define a quarter-round radius extending from a forward surface tangent to a first line parallel to the panel inserts, to an end near the back of the sign tangent to a second line perpendicular to the first line. Other shapes will suggest themselves to those skilled in the art.

Figure 6:
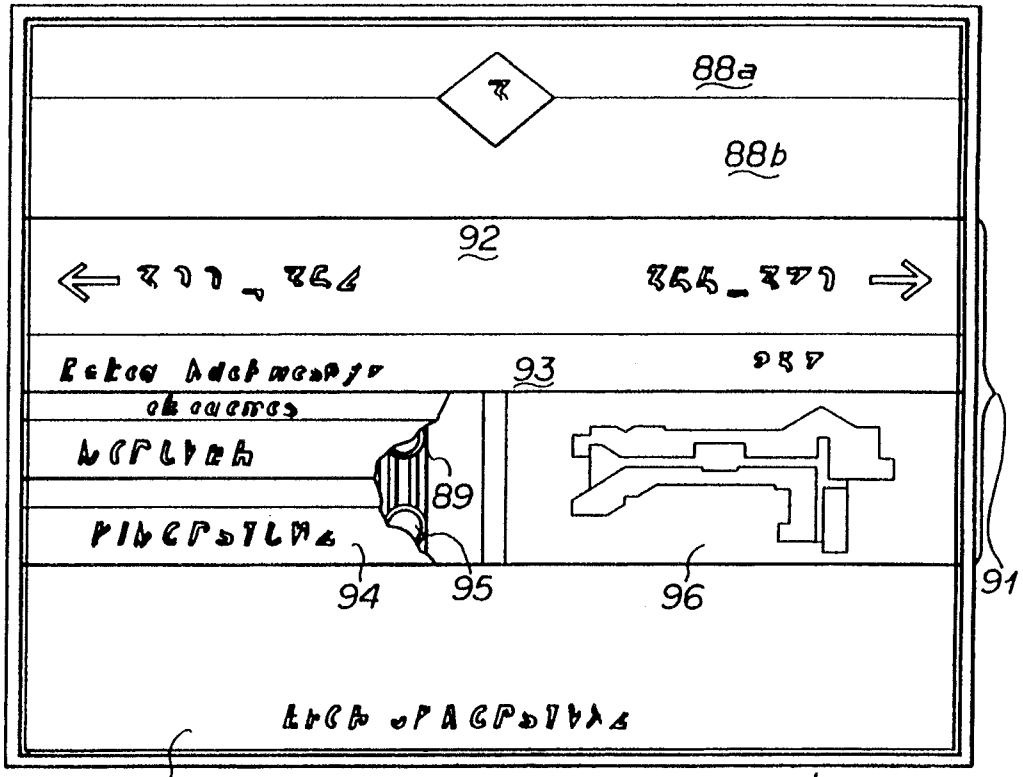
FIG. 6 is an elevation view of another typical directory sign according to the present invention, illustrating one of many alternative layouts made possible by use of the present invention.
Figure 5:
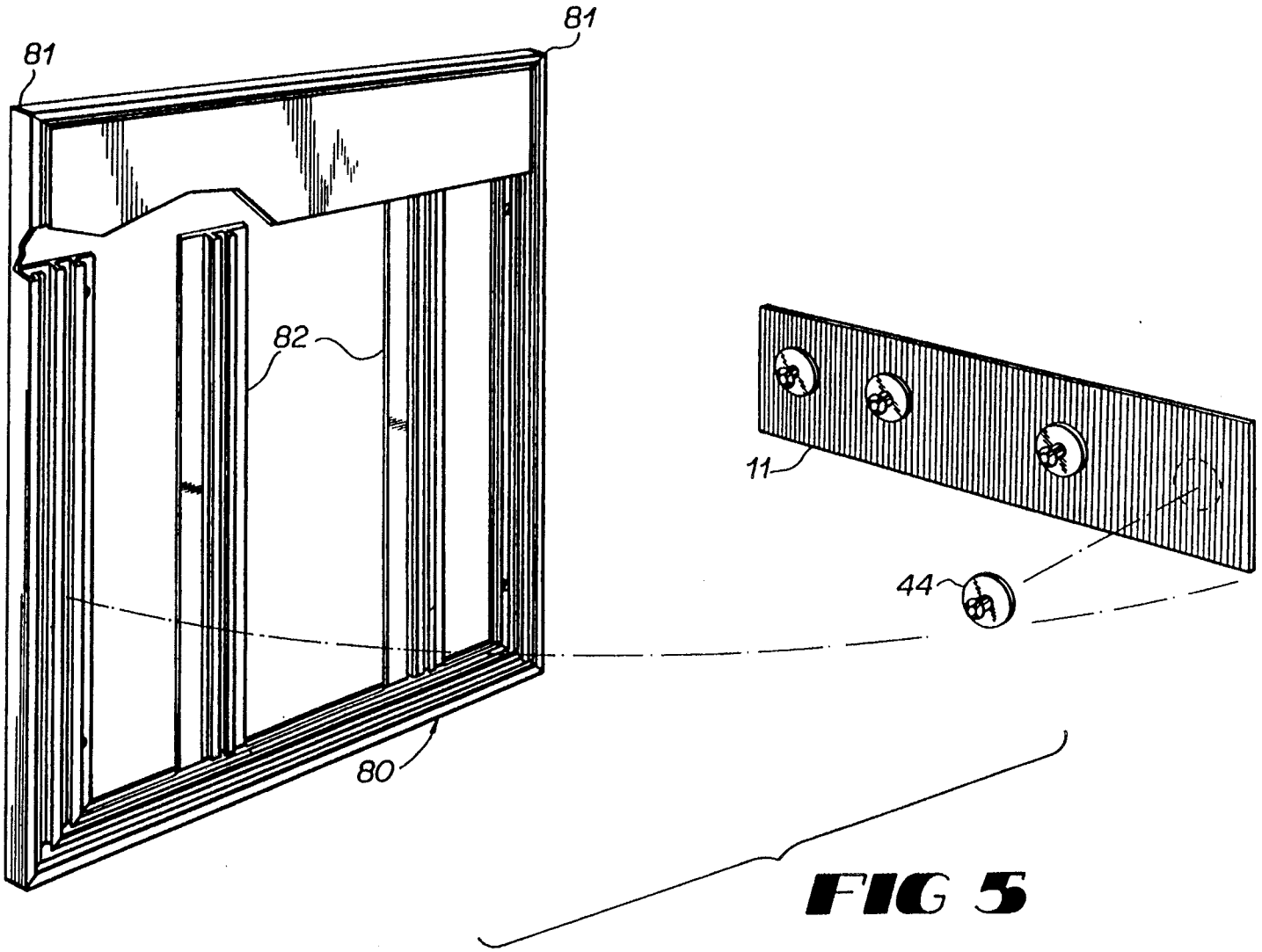
FIG. 5 is an exploded view showing a directory sign according to a second preferred embodiment of the present invention.

FIGS. 5 and 6 show another directory sign 80 according to an alternative embodiment of the invention. The sign 80 has square corners 81 in contrast with the radius corners of the sign 10, and illustrates the use of two intermediate rails 82 in a directory sign whose width may be greater than that of the sign 10. Further yet, the intermediate rails 82 lack the support surfaces 58 and related structure described above with respect to the intermediate rail 32, showing the optional nature of those support surfaces.

It should now be evident that the present invention allows considerable flexibility of design in preparing directory signs and other kinds of signs. This flexibility is obtained by the use of rails for supporting panel inserts, in combination with the fasteners that extend into channels in the rails and permit positioning the panel inserts at any location along the length of the rail. The use of square corners in signs according to the present invention, as shown in FIGS. 5 and 6, allows greater flexibility of layout than the rounded-comer embodiment previously described. The full height of the sign 80 is available for displaying indicia, and the width of the sign is not limited by the need to stock or fabricate special header and base inserts such as the elements 10 and 12. Because the uppermost and lowermost panel inserts 11 used in the square-corner sign 80 may have the same configuration as other panel inserts used with that sign, the intermediate rails 82 and the unnumbered side rails of the sign 80 extend the entire height of the sign so as to give those uppermost and lowermost panel inserts the same flexibility of positioning as the other panel inserts.

FIG. 6 shows one example of a sign illustrating the flexibility of layout and design made possible according to the present invention. In that figure, the sign 85 has a base insert 86 that can contain a general legend such as "Elevators Located In Main Lobby," with information concerning persons or places being located above the base insert in the middle region of the sign. The header 87 of the sign 85 comprises two separate panel inserts 88*a* and 88*b* positioned one above the other. It can be seen that the panel insert 88*a* is one-half the width of the insert 88*b*, and that the combined width of both those inserts is the same as the width of the base insert 86.

The middle part 91 of the sign 85 includes two panel inserts 92 and 93 of unequal heights, but of full width, extending across the entire width of the sign. These two inserts contain suitable indicia. Located below the panel insert 93 are a number of half-width panel inserts 94 of different heights. These inserts 94 extend only across one-half the width of the sign 85, and are held in place by fasteners 95 (FIG. 6) engaging the intermediate rail 89 and the side rail (not shown in that Figure) at the left side of the sign. To the right of the several half-length panel inserts 94 is a single additional half-length panel insert 96 whose width equals the combined widths of the several inserts 94. This insert 96 in the disclosed embodiment contains a map depicting the area serviced by the directory sign 85, and is held in place on that sign by another intermediate rail and the side rail at the right side of the sign. Any panel insert making up the sign 85 can be removed in the manner disclosed above, leaving space for a new arrangement of inserts if desired, or simply for changing the name or office location of persons or places previously displayed on the sign.

It should also be understood that the basic design and construction shown heroin can be applied as well to signs or to other message display panels, and is not limited to use in directory signs or the like. For example, wall-size display boards made up of no modular components can be mounted on vertical rails having the slotted channels as described herein. These components on their back surface will have fasteners similar to the fasteners 44, allowing the panels to snap into engagement with the rails and then permitting positioning of the panels to a desired position along the length of the rails.

It should also be understood that the foregoing relates only to preferred embodiments of the present invention and that numerous changes and modifications therein may be made within the spirit and scope of the invention as defined in the following claims.

What is claimed is:

1. Sign apparatus having a positionable sign insert, comprising:

a sign insert having a front surface and a back surface;

an elongated support member disposed for juxtaposition with the back surface of the sign insert, the support member having a channel and a slot facing the back surface and providing access to the channel;

a fastener on the back surface of the sign insert for alignment with the slot;

the fastener being elastically deformable to pass through the slot and enter the channel and thereafter expanding within the channel to a configuration exceeding the width of the slot; and the fastener thereafter being slidable within the channel so that the sign insert is retained against the support member in sliding relation to the slot and can be positioned along the support member by sliding the fastener.

2. The sign apparatus as in claim 1, wherein:

the sign insert is elongated having a length greater than a width and is is disposed on the elongated support member having a length greater than a width in substantially planar parallel relation to the support member, so that the sign insert extends substantially transverse to the support member and can be positioned along the length of the support member.

3. Sign apparatus as in claim 1, wherein;

the support member comprises a front surface for contact by the back surface of the sign insert retained against the support member, and a recessed region of predetermined depth flanking the slot and located behind the front surface; and the fastener comprises deformable means extending through the recessed region to engage the slot and enter the charmel, whereby the thickness of the slot through which the deformable means must pass to enter the charmel is reduced by the depth of the recessed region flanking the slot.

4. The sign apparatus as in claim 1, wherein:

the support member comprises a support surface for contact by the back surface of the sign insert retained against the support member; and the fastener is configured to urge the back surface of the sign insert into contact with the support surface of the support member, so that the sign insert is held in close proximity to the support member.

5. The sign apparatus as in claim 1, wherein:

the support member comprises a front surface for contact by the back surface of the sign insert retained against the support member; and the fastener includes means having a distal portion received within the channel and there engaging the support member so as to prevent unimpeded withdrawal from the channel, and defining a predetermined forward spacing from the distal end to the sign insert operative to maintain the back surface of the sign insert in engaging contact with the front surface of the support member, so that the sign insert is retained in a selected position on the support member while being selectively positionable along the length of the support member.

6. The sign apparatus of claim 1, wherein:

the fastener comprises deformable means having a portion proximal to the sign insert for sliding passage within the slot and a distal portion larger than the width of the slot so as to prevent unimpeded withdrawal therethrough;

the fastener means being elastically deformable to permit the distal end to pass through the slot and enter the channel when the distal end is pressed against the slot; and the channel is sized to allow the fastener to expand from its deformed size after the distal end passes through the slot and enters the channel, whereupon the expanded distal end prevents unimpeded withdrawal of the fastener from the slot but does not prevent sliding passage of the fastener through the slotted channel so that the sign insert can be positioned relative to the support member.

7. The sign apparatus as in claim 6, wherein:

the distal portion has a surface which contacts a confronting surface within the channel to prevent said unimpeded withdrawal of the fastener from the channel; and the surface of the distal portion is spaced from the sign insert a distance operative to maintain the back surface of the sign insert in engaging contact with the front surface of the support member, so that the sign insert is retained in a selected position on the support member while being selectively positionable along the support member.

8. The sign apparatus as in claim 6, wherein:

having a length greater than a width the sign insert is elongated and is disposed on the elongated support member having a length greater than a width in substantially transverse relation to the support member, so that the length of the sign insert extends substantially transverse to the length of the support member and can be positioned along the length of the support member.

9. Sign apparatus as in claim 6, wherein the support member comprises:

a front surface for contact by the back surface of the sign insert retained against the support member; and a recessed region of predetermined depth flanking the slot and inset from the first surface so that the deformable means of the fastener extends through the recessed region before reaching the slot, whereby the thickness of the slot through which the deformable means must pass to enter the channel is reduced by the depth of the recessed region flanking the slot.

10. Sign apparatus comprising:

a holder having sides defining a perimeter for the sign apparatus;

a plurality of elongate support members associated with the holder within the perimeter and parallel to each other within the holder;

each support member including an elongate channel;

at least one sign insert having a front surface and a back surface operative for placement in predetermined juxtaposition with the support members;

fasteners on the back surface of the sign insert for alignment with the channels of the respective support members;

the fasteners being elastically deformable to enter the channels and thereafter expandable within the channels to a configuration substantially inhibiting withdrawal from the channels; and the fasteners thereafter being slidable within the channels so that the sign insert is retained in juxtaposition against the support member in sliding relation to the channels and can be positioned to any desired location along the support member by sliding the fasteners within the channels.

11. Apparatus as in claim 10, wherein:

at least one of the support members has a front surface for supporting the back surface of sign inserts retained by the support members; and the sides of the holder define a front surface of the sign apparatus located in fixed depthwise relation to the front surface of the support members, so that the depth relation between the front surface of the sign apparatus and the front surface of the one support member maintains the front surface of the sign inserts in a predetermined depth relation with the front surface of the sign apparatus.

12. Apparatus as in claim 11, wherein:

said sign inserts have at least one marginal portion with an outer surface inset in depth from the front surface of the sign insert;

the marginal portion is disposed adjacent a side of the holder; and the inset of the marginal portion is positioned in depth behind the adjacent front surface of the holder so as to produce the appearance of a reveal between the holder and the sign insert.

13. Apparatus as in claim 10, wherein:

each support member has the front surface for supporting the back surface of the sign inserts retained by the support members; and the sides of the holder have a front surface defining the outermost portion of the frame and a rearwardly-extending surface located in proximate relation to a contiguous end of the sign inserts supported by the support members.

14. Apparatus as in claim 13, wherein:

the rearwardly-extending surface joins a flange extending outwardly therefrom and being substantially parallel to the front surface of the support member adjacent the rearwardly-extending surface; and the flange underlies an end of the sign insert so as to augment the appearance of the reveal and to conceal from view the structure behind the end of the sign insert.

15. Apparatus for selectively attaching a panel to a workpiece, the apparatus comprising:

a plurality of elongated support members supported by the workpiece, each support member having a channel and a slot providing access to the channel, and the slot facing outwardly from the workpiece on which the channel is supported;

a panel;

a fastener having means attached to the panel and elastically deformable by application of a first amount of force to pass through the slot and enter the channel;

the fastener means being expandable within the channel to a configuration exceeding the width of the slot and being withdrawable from the channel only in response to force greater than the first amount, thereby impeding removal of the panel from the elongated support member; and the fastener thereafter being slidable within the channel so that the panel is retained in sliding relation to the channel and can be positioned relative to the workpeice by sliding the fastener along the length of the elongated support member.

16. Apparatus as in claim 15, wherein:

the fastener means comprises a terminal portion elastically deformable to pass through the slot and enter the channel and expandable within the channel to a configuration exceeding the width of the slot so as to impede withdrawal of the terminal portion from the channel;

the fastener has a proximal portion operative for attachment to the panel being attached to the workpiece; and the expanded terminal poriton of the fastener is slideable within the channel.

17. Apparatus as in claim 16, wherein:

the elongated support members have a front surface facing a back surface of the panel retained against the elongated support members, and a recessed region of predetermined depth flanking the slot and coextensive with the slot along the front surface; and the deformable terminal portion of the fastener is operative to extend through the recessed region to enter the slot, whereby the thickness of the slot through which the deformable means must pass to enter the channel is reduced by the depth of the recessed region flanking the slot, so as to reduce amounts of force required to insert the terminal portion in the channel and to remove the terminal portion therefrom.

18. Apparatus as in claim 16, wherein:

the fastener comprises an intermediate portion between the proximal and terminal portions for sliding passage within the slot;

the width of the terminal portion is greater than the width of the slot so as to prevent unimpeded passage therethrough; and the channel is sized to allow the fastener to expand to its undeformed size after the terminal portion passes through the slot and enters the channel, whereupon the expanded terminal portion inhibits withdrawal of the fastener from the slot but does not prevent sliding passage of the intermediate portion through the slotted channel, so as to permit positioning the panel relative to the elongated support members.

19. The apparatus as in claim 18, wherein:

the terminal portion has a surface which expands to contact a confronting surface within the channel to inhibit withdrawal of the fastener from the channel, so that the panel is retained in a selected position on the support member while being selectively positionable along the support member.

20. The apparatus as in claim 18, wherein:

the panel is elongated and is disposed on the support members in substantially transverse relation to the support members, so that the panel extends substantially transverse to the support members and is operable for slideable positioning anywhere along the length of the support members.

* * * * *